US007591771B2

(12) United States Patent
Rullestad et al.

(10) Patent No.: US 7,591,771 B2
(45) Date of Patent: Sep. 22, 2009

(54) APPARATUS AND METHOD FOR FACILITATING THE SAFE LIFTING OF FREE WEIGHTS

(75) Inventors: Korey W. Rullestad, Kansas City, MO (US); Nathaniel J. Boone, Tonganoxie, KS (US); Jeremiah K. Shull, Hughesville, MO (US)

(73) Assignee: Julia A. Redding, Kansas City, MO (US)

( * ) Notice: Subject to any disclaimer, the term of this patent is extended or adjusted under 35 U.S.C. 154(b) by 697 days.

(21) Appl. No.: 11/102,281

(22) Filed: Apr. 8, 2005

(65) Prior Publication Data

US 2006/0135324 A1 Jun. 22, 2006

Related U.S. Application Data

(60) Provisional application No. 60/637,952, filed on Dec. 20, 2004.

(51) Int. Cl.
*A63B 21/00* (2006.01)

(52) U.S. Cl. ..... 482/104; 482/112

(58) Field of Classification Search ..... 482/104–108, 482/92, 94, 112, 111
See application file for complete search history.

(56) References Cited

U.S. PATENT DOCUMENTS 4,799,672 A * 1/1989 Barrett ..... 482/104
4,822,034 A 4/1989 Shields
4,848,737 A * 7/1989 Ehrenfield ..... 482/52
4,856,773 A 8/1989 Deola
4,875,676 A 10/1989 Zimmer
4,934,693 A 6/1990 Santoro
4,998,723 A 3/1991 Santoro
5,011,140 A 4/1991 Adessi
5,048,826 A 9/1991 Ryan
5,082,259 A 1/1992 Gonzalez
5,217,421 A 6/1993 Chrysler
5,281,193 A 1/1994 Colbo, Jr.
5,314,394 A * 5/1994 Ronan ..... 482/104
5,407,403 A * 4/1995 Coleman ..... 482/6
5,468,203 A 11/1995 Okonkwo
5,653,666 A 8/1997 Pantoleon
5,669,859 A 9/1997 Liggett et al.
5,836,858 A 11/1998 Sharff (Continued)

*Primary Examiner*—Jerome Donnelly
(74) *Attorney, Agent, or Firm*—Hovey Williams LLP

(57) ABSTRACT

A free-weight bench (10) is provided having a safety assist device (12) for preventing injury to a weight lifter who repetitively lifts a barbell weight (16) including a weight bar (42). The safety assist device (12) includes a pair of spaced apart arms (32,34) oriented to permit the bar (42) to move along the length thereof, and a bar-sensing apparatus (45) comprising a plurality of sensors (46) on the arms (32,34) as well as a processor (60) programmed to determine at least one parameter related to the velocity of the bar (42) as it moves along the arms (32,34). Respective extensible supports (47) comprising fluid-actuated piston and cylinder assemblies (48,50) are located adjacent corresponding arms (32,34) and are controlled by the processor (60). In the event that a lifter loses control of the barbell weight (16) causing the latter to rapidly descend, the processor (60) receives bar-position signals from the sensors (46) and calculates a velocity-related parameter; the processor (60) then initiates operation of the supports (47) in order to arrest the downward descent of the barbell weight (16) to prevent injury to the lifter.

11 Claims, 4 Drawing Sheets

U.S. PATENT DOCUMENTS 5,989,164 A 11/1999 Kullman et al.
5,989,166 A 11/1999 Capizzo et al.
6,623,409 B1 * 9/2003 Abelbeck ..... 482/104
6,746,379 B1 6/2004 Brawner

* cited by examiner

APPARATUS AND METHOD FOR FACILITATING THE SAFE LIFTING OF FREE WEIGHTS

CROSS-REFERENCE TO RELATED APPLICATION

This application claims priority benefit of identically titled Provisional Application Ser. No. 60/637,952, filed Dec. 20, 2004, and such Provisional Application is incorporated by reference herein.

BACKGROUND OF THE INVENTION

1. Field of the Invention

The present invention is broadly concerned with an apparatus for facilitating safe free-weight exercises in order to minimize the possibility of injury to the weight lifter or adjacent equipment. More particularly, the invention is concerned with such safety apparatus, as well as overall free-weight exercise devices and corresponding methods, wherein a bar-sensing apparatus is preferably employed, including a plurality of weight position sensors located to monitor the weight during lifting thereof, as well as a processor for calculating a parameter related to the velocity of the weight. The processor is also coupled with extensible supports, which are operated in the event that the lifter loses control of the weight.

2. Description of the Related Art

Free-weight enthusiasts typically perform lifting exercises in a supine position on a padded weight bench or while standing. These exercises involve raising and lowering a barbell weight through a series of repetitions, and very often the lifter will continue the repetitions to a point where he or she can no longer continue them. A common problem with this type of lifting regimen is that the lifter may lose control of the barbell, with the result that it may injure the user or harm adjacent flooring or equipment.

In light of this, it is common for a lifter to enlist the aid of a "spotter," who monitors the lifter's exercise repetitions and is available to "catch" the barbell in the event that the lifter begins to lose control. Notwithstanding the presence of a spotter however, the same types of problems can occur, particularly if very heavy weights are involved. Furthermore, the need for a spotter makes it impossible for a weight lifter to perform this and other types of lifting exercises alone.

U.S. Pat. No. 6,746,379 describes a bench press apparatus making use of assist hydraulic cylinders which can be actuated by the lifter through a foot pedal or similar expedient. However, the type of apparatus described in this patent does not fully solve the weight lifter's dilemma because the lifter may be unable to timely initiate operation of the support cylinders, especially where the barbell is dropped.

The art is replete with other types of barbell systems and weight lifting devices. See, U.S. Pat. Nos. 4,822,034; 5,082,259; 6,774,320; 6,436,016; 5,755,823; 5,603,677; and 5,203,425. However, none of these references fully address or solve the problems outlined above.

SUMMARY OF THE INVENTION

The present invention overcomes the noted safety issues and provides a safety assist device for use with an elongated weight bar. The assist device comprises a pair of elongated, spaced apart arms oriented to permit the weight bar to move along at least a portion of the length thereof; and a bar-sensing apparatus including a plurality of sensors located along the length of at least one of the arms. The sensing apparatus is operable to determine at least one parameter related to the velocity of the bar as the bar moves along the length of the arms. A support is also associated with each arm respectively and includes a shiftable, bar-supporting element. The supports are operably coupled with the bar-sensing apparatus in order to shift the elements to a bar-supporting position in the event that the at least one velocity-related parameter is outside of a predetermined parameter range.

In preferred forms, the arms are upright and present guide slots for receiving the ends of the weight bar, and the sensors are faced along the length of the upright arms. The sensors are coupled with a digital processor programmed to calculate the selected velocity parameter, based upon the sensed positions of the bar during movement thereof. The preferred extensible supports are in the form of fluid-actuated piston and cylinder assemblies, most preferably hydraulic or pneumatic cylinder assemblies.

The methods of the invention involve providing a weight to be lifted and allowing a user to repetitively raise and lower the weight. The weight is monitored during the raising and lowering thereof, and at least one parameter related to the velocity of the weight is determined during such monitoring. In the event that the determined parameter falls outside of a predetermined parameter range, a weight-supporting element is moved into engagement with the weight in order to at least partially support the weight apart from the user.

DETAILED DESCRIPTION OF THE INVENTION

Figure 1:
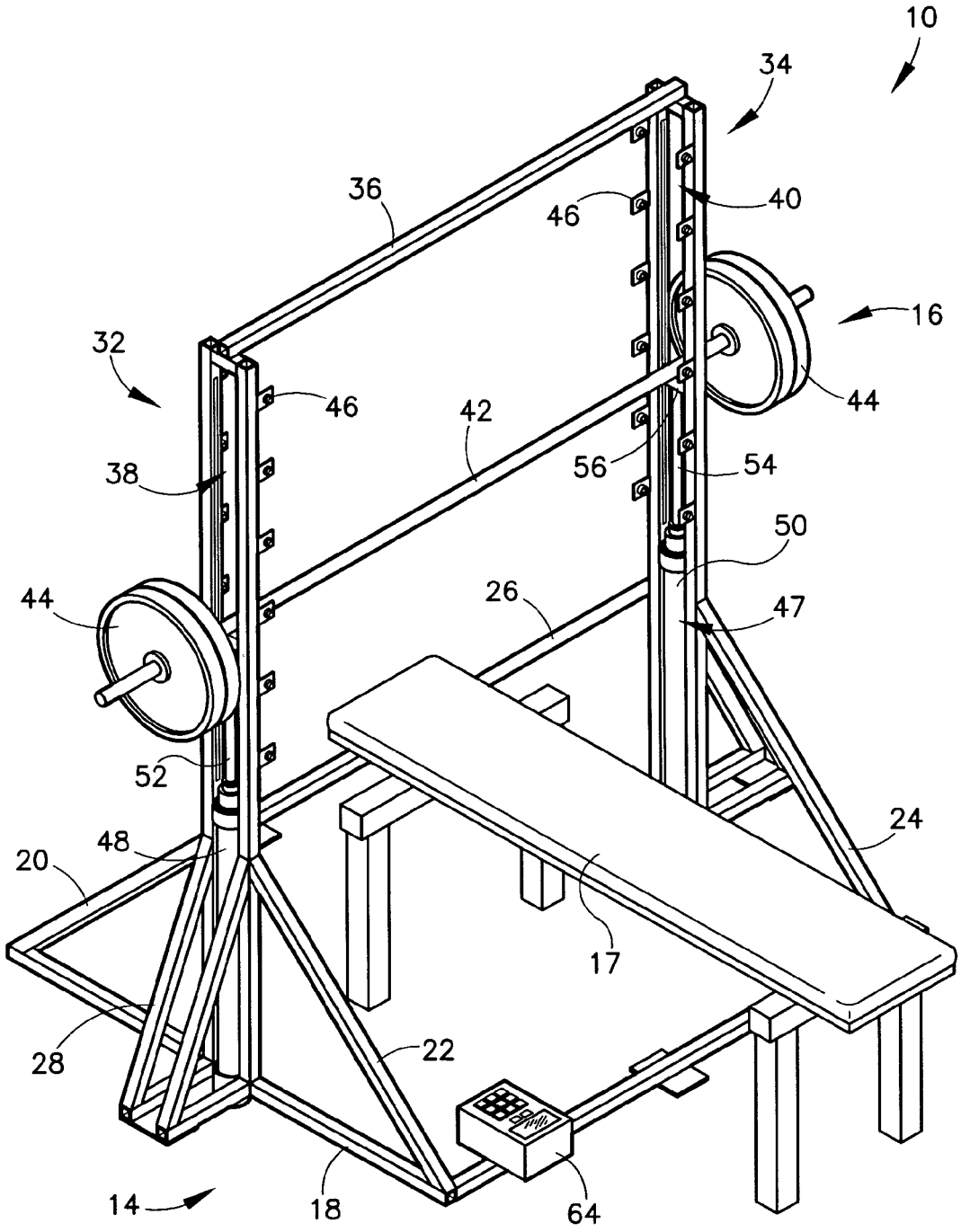
FIG. 1 is a perspective view of a free-weight bench in accordance with the invention, having the safety assist device as a part thereof.

Turning now to the drawings, a free-weight bench 10 is illustrated in FIG. 1 and includes a safety assist device 12 (see FIG. 4) of the invention. Broadly speaking, the bench 10 includes a frame assembly 14, a barbell weight 16 supported within the device 12, and a padded user bench 17.

Figure 2:
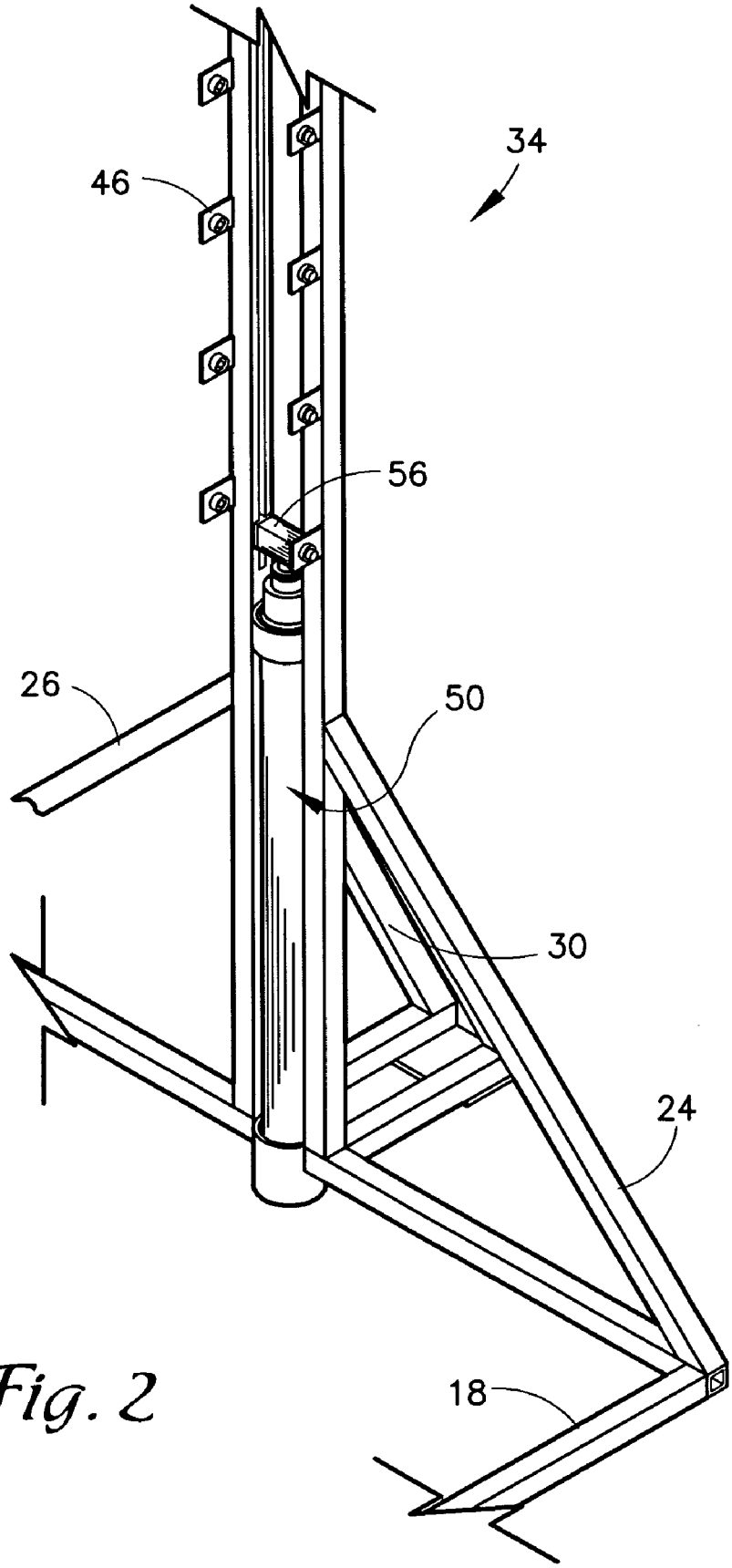
FIG. 2 is a fragmentary perspective view of a portion of the bench of FIG. 1, illustrating one of the support cylinders in its lowered position.
Figure 3:
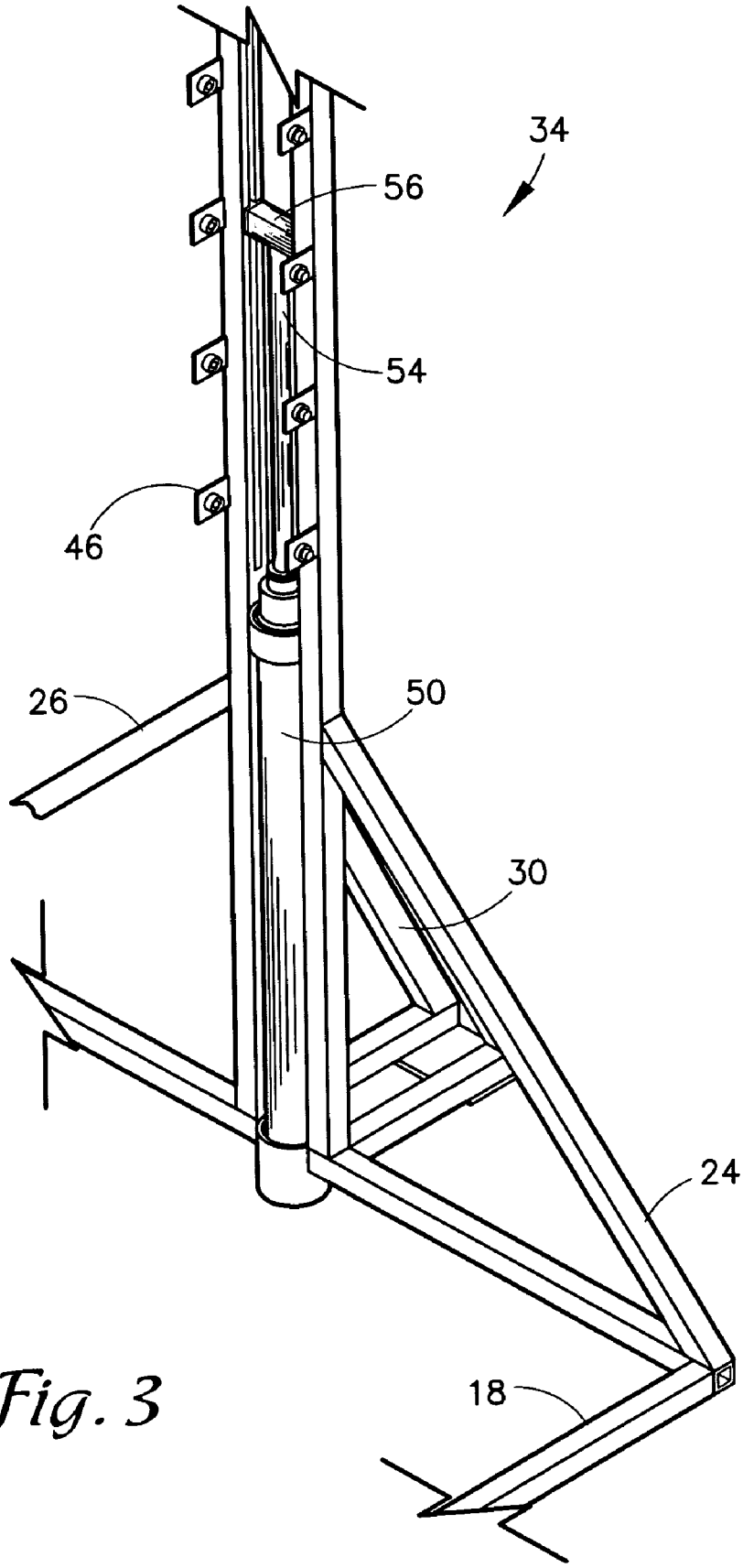
FIG. 3 is a fragmentary perspective view similar to that of FIG. 2 but illustrating the support cylinder in an elevated position.

As illustrated in FIGS. 1-3, the frame assembly 14 includes a rectangular floor-engaging section 18; upwardly extending, oblique support members 20,22,24,26; and opposed struts 28,30. The frame assembly 14 supports a pair of spaced apart, bifurcated arms 32,34 forming a part of safety assist device 12 and interconnected by an uppermost rail 36. The arms 32,34 present corresponding elongated vertical guide tracks or slots 38,40.

The barbell weight 16 is itself entirely conventional and comprises an elongated weight bar 42 adapted to receive endmost weights 44. As best seen in FIG. 1, the bar 42 passes through and is vertically shiftable along the length of the arm slots 38,40. As is readily apparent, the barbell weight 16 is designed to be repetitively raised and lowered by a user (not shown) lying in a supine position on bench 17. In an alternative implementation, the bench 17 can be removed, and the user can lift the weight 16 without use of the bench 17, such as if the user were performing squats.

Figure 4:
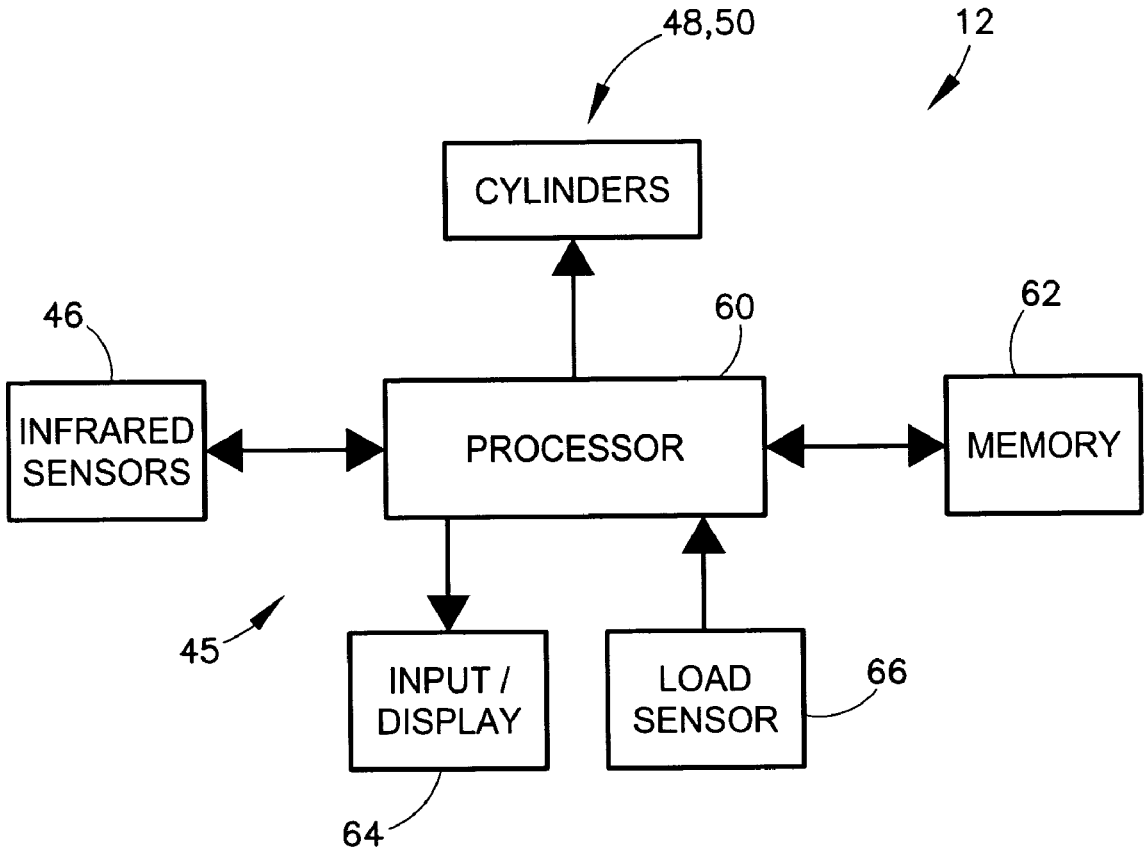
FIG. 4 is a block diagram illustrating the operative connection of the components of the safety assist device.

The safety assist device 12 includes, in addition to the arms 32,34, bar-sensing apparatus 45, as illustrated in FIG. 4. The bar-sensing apparatus 45 includes a plurality of sensors 46 positioned along the length of each arm 32,34 in spaced relationship to each other, as illustrated in FIGS. 1-3. While a variety of sensors can be used in this context, conventional infrared sensors are preferred. The device 12 further includes a support 47 associated with each arm 32,34 respectively and including a shiftable, bar-supporting element 56. In preferred form, the supports 47 comprise a pair of fluid-actuated piston and cylinder assemblies 48,50 located in an upright orientation adjacent each arm 32,34. The assemblies 48,50 may be hydraulic or pneumatic, and each include an extensible piston rod 52,54 surmounted by the bar-supporting element, which is preferably a weight bar-engaging and supporting pad 56. The cylinder assemblies 48,50 are operable to shift the bar to a plurality of locations along the length of arms 32,34, as discussed in more detail below.

The operative connection between the components of the safety assist device 12 is schematically illustrated in FIG. 4. That is, in preferred forms, the bar-sensing apparatus 45 comprises the sensors 46, and a digital processor 60 equipped with a memory module 62. As shown, the sensors 46 are operably connected to the processor 60, and the processor 60 is also connected to conventional fluid pumps and valves (not shown) forming a part of the piston and cylinder assemblies 48,50, in order to actuate the latter. The processor 60 is programmed so as to receive information from the sensors 46 and to calculate at least one parameter related to the velocity of the bar 42 as it moves along the length of the arms 32,34. This velocity parameter is preferably selected from the group consisting of velocity, instantaneous velocity, average velocity, acceleration, instantaneous acceleration, and average acceleration. Moreover, the processor 60 is programmed to operate the cylinder assemblies 48,50 in the event that the calculated velocity parameter is outside of a predetermined range for that parameter.

As also shown in FIG. 4, an optional input/display device 64 and a load sensor 66 may be connected to the processor 60. The input/display device 64 allows the user to input user information such as user identity, date, weight amounts, and exercise regimen. The display 64 allows the user to track his or her progress during and after an exercise session. The load sensor 66 may be coupled to the respective piston cylinder assemblies 48,50 for automatically determining the weight load being lifted.

In use, the user selects a weight to be lifted by attaching the appropriate weights 44 to the outboard ends of the weight bar 42. If the input/display 64 is employed, user information may be inputted to the processor 60. The user then begins lifting the barbell weight 16 within the slots 38,40; this typically involves a regimen where the barbell weight 16 is raised and lowered repetitively. As long as the user maintains proper control of the barbell weight 16, the safety assist device 12 does not come into play. However, if for example, the user loses control of the barbell weight 16 when in a raised position, the barbell will begin to rapidly descend within the slots 38,40. This is immediately detected by virtue of the fact that the bar 42 passes the sensors 46, allowing the processor 60 to determine a velocity parameter such as acceleration. The determined parameter is then compared with predetermined limits in a look-up table within memory module 62. If the parameter is outside of such limits, the processor sends an operating signal to the piston and cylinder assemblies 48,50, causing the piston rods 52,54 thereof to immediately extend to a point where the pads 56 engage the underside of bar 42 and thereby at least partially support the weight of the barbell weight 16 apart from the user. Thus, the uncontrolled downward descent of the weight 16 is arrested so as to prevent injury to the user.

In another scenario, the user may be lifting the weights 16 and nearing the end of his or her strength, with the effect that the upward movement of the bar 42 becomes very slow. This low velocity movement of the bar is again detected by the sensors 46, and such information is transmitted to the processor 60, thus causing the cylinder assemblies 48,50 to extend and support the weight 16 before the user loses control thereof.

The present invention is susceptible to many variations and alternatives. For examples, the arms 32,34 need not be rectilinear but may be arcuate; the sensors 46 may be of various types; the supports 47 could be stepper motors or other mechanical devices in lieu of fluid actuated cylinder assemblies 48,50; and the pads 56 may be secured to the ends of bar 42, in which case the assemblies 48,50 would be operated during raising and lowering of the bar 42 to negate the effect of the interconnection between the assemblies 48,50 and the bar 42.

The invention claimed is:

1. A safety assist device for use with an elongated weight bar for supporting said weight bar in the event of a user failure or fatigue during weightlifting exercises, the safety assist device comprising:

at least two pairs of elongated, spaced apart arms, each pair of arms oriented to receive a respective end of said weight bar therethrough so as to permit said weight bar to move along a length of each pair of arms;

a bar-sensing apparatus including at least two sensors intermittently located along at least a portion of the length of said arms, said at least two sensors operable to collectively determine at least one parameter related to the velocity of the bar as the bar moves along the length of the pairs of arms; and a support associated with each pair of arms respectively and including a shiftable, bar-supporting element operable to extend along at least a portion of the length of its respective pair of arms, wherein said supports are operable to shift said bar-supporting elements to a bar-supporting position so as to completely arrest movement of said weight bar and to completely support said weight bar in the event that said at least one parameter is outside of a predetermined parameter range due to the user failure or fatigue.

2. The device of claim 1, said arms being upright and substantially rectilinear.

3. The device of claim 1, there being a frame assembly supporting said arms.

4. The device of claim 1, said sensors comprising infrared sensors.

5. The device of claim 1, said bar-sensing apparatus including a processor operably coupled with said sensors in order to determine said at least one parameter.

6. The device of claim 1, said at least one parameter selected from the group consisting of velocity, instantaneous velocity, average velocity, acceleration, instantaneous acceleration, and average acceleration.

7. The device of claim 1, said supports comprising fluid-actuated piston and cylinder assemblies.

8. The device of claim 7, said supports comprising hydraulic piston and cylinder assemblies.

9. The device of claim 1, said bar-supporting elements comprising bar-engaging pads.

10. The device of claim 5, including an input unit allowing an individual user to input identifying information into said processor.

11. The safety assist device of claim 1, wherein the at least one parameter determined by the bar-sensing apparatus is a decreased velocity.

* * * * *